US005110787A

United States Patent [19]

Yukita et al.

[11] Patent Number: 5,110,787

[45] Date of Patent: May 5, 1992

[54] ROLL PAPER FOR THERMAL PRINTER

[75] Inventors: Yasuo Yukita; Masakazu Sone, both of Tokyo; Hidehiko Funayama, Kanagawa, all of Japan

[73] Assignee: Sony Corporation, Tokyo, Japan

[21] Appl. No.: 611,503

[22] Filed: Nov. 13, 1990

[30] Foreign Application Priority Data

Nov. 16, 1989 [JP] Japan ..... 1-133167[U]

[51] Int. Cl.[5] ..... B41M 5/30

[52] U.S. Cl. ..... 503/206; 428/42; 503/226

[58] Field of Search ..... 428/42; 503/206, 226

[56] References Cited

U.S. PATENT DOCUMENTS 4,940.690 7/1990 Skees ..... 503/206

FOREIGN PATENT DOCUMENTS 101311 2/1984 European Pat. Off. ..... 503/206
876101 8/1961 United Kingdom ..... 428/42
1543583 4/1979 United Kingdom ..... 503/206

*Primary Examiner*—Bruce H. Hess
*Attorney, Agent, or Firm*—Hill, Van Santen, Steadman & Simpson

[57] ABSTRACT

A roll paper for a thermal printer in which a coloring paper having a thermal coloring layer and a peeling paper on which the coloring paper with the coloring layer is stuck by an adhesive material are wound as a roll shape is comprised of first cuts for defining a picture forming region of one frame on the coloring paper in order for the picture forming region to be peeled off from the peeling paper and second cuts formed to completely cross the entire width of the roll paper, in which the first and second cuts are repeatedly formed at every picture forming region in the length direction of the roll paper.

5 Claims, 4 Drawing Sheets

ROLL PAPER FOR THERMAL PRINTER

BACKGROUND OF THE INVENTION

1. Field of the Invention

The present invention relates generally to roll papers and, more particularly, to a roll paper for a thermal printer for use in a video graphic printer or the like.

2. Description of the Prior Art

Recently, it has been requested that prepaid cards such as telephone cards, commutation tickets, ID (identification) cards and so on can individually record picture and character informations on their surfaces in order to keep a close relationship with money and security. A video graphic printer is known to meet with such requirements. The video graphic printer employs a thermal print head for printing picture and character information on a heat-sensitive coloring paper having a heat-sensitive coloring layer.

FIGS. 1–4 show arrangements of conventional roll papers for a thermal printer, and FIG. 1 shows a perspective view of a roll paper for a thermal printer which is most generally utilized for such video graphic printer.

As shown in FIG. 1, a coloring paper 3 having a thermal coloring layer is stuck on a peeling paper 2 by an adhesive. The resultant paper is rolled around a bobbin or spool 1. This roll paper is fed to a printer (not shown) and picture and character informations are recorded on the coloring paper 3 by a thermal print head.

This roll paper for a thermal printer encounters with a problem. That is, if the coloring paper 3 with the peeling paper 2 stuck thereunder is rolled around the spool 1, then a so-called rolling difference or feeding difference with respect to the axis thereof occurs between the peeling paper 2 and the coloring paper 3, causing wrinkles 4 on the coloring paper 3 as shown in FIG. 1, which results in poor printing.

FIG. 2 is a cross-sectional side view illustrating a portion shown by a circular arrow A in FIG. 1 in an enlarged scale. As shown in FIG. 2, the wrinkle 4 of the coloring paper 3 is raised in a bank shape from the peeling paper 2 in response to the amount of the feeding difference.

In order to solve the aforenoted problems, a roll paper for a thermal printer is proposed as shown in FIGS. 3 and 4.

As shown in FIGS. 3 and 4, starting point detection apertures 5 are bored at a predetermined pitch through the peeling paper 2 along its longitudinal direction. After each of the detection apertures 5, 5, . . . , an image forming portion in which picture and character informations are recorded, that is, a sheet of a substantially rectangular label-like thermal coloring paper 3*a* having a coloring layer is stuck on the peeling paper 2 by an adhesive (not shown). Then, the peeling paper 2 having the sheet of label-like coloring paper 3*a* stuck thereon is rolled around the spool 1. If the peeling paper 2 on which the sheet of coloring paper 3*a* having the thermal coloring layer is stuck as described above is rolled around the spool 1, the occurrence of wrinkles 4 due to the feeding difference in the rolling-process as described with reference to FIGS. 1 and 2 can be avoided and thus the poor printing can also be avoided.

The roll paper for a thermal printer shown in FIGS. 3 and 4 can prevent the wrinkles 4 from being produced upon rolling and thus eliminate the defective printing, but it has the following problem. As shown in FIG. 4, when a thermal print head 6 is brought in contact with the label-like coloring paper 3*a* on the thermal rolled paper 3 to record picture or character information, the thermal print head 6 touches the edge of the label-like coloring paper 3*a* upon recording to cause the latter to be peeled off from the peeling paper 2 because there is a level difference 7 between the coloring paper 3*a* and the peeling paper 2. As a result, a so-called jamming occurs so that picture and character informations cannot be recorded on the coloring paper 3*a*, and also stripes are formed on the image forming area due to the level difference upon winding, thus causing defective printing.

OBJECTS AND SUMMARY OF THE INVENTION

Accordingly, it is an object of the present invention to provide an improved roll paper for a thermal printer in which the aforenoted shortcomings and disadvantages of the prior art can be substantially eliminated.

More specifically, it is an object of the present invention to provide a roll paper for a thermal printer in which wrinkles are not caused at all.

It is another object of the present invention to provide a roll paper for a thermal printer in which any defecting printing is not caused.

It is a further object of the present invention to provide a roll paper for a thermal printer in which a picture forming portion can be prevented from being peeled unintentionally.

It is yet a further object of the present invention to provide a roll paper for a thermal printer in which a so-called jamming can be prevented from occurring.

According to an aspect of the present invention, a roll paper for a thermal printer in which a coloring paper having a thermal coloring layer and a peeling paper are stuck one upon the other by an adhesive material as a roll paper is comprised of first cuts for defining picture forming regions of frames on the coloring paper in order for the picture forming regions to be peeled off from the peeling paper and second cuts formed to completely cross the entire width of the roll paper, in which the first and second cuts are repeatedly formed at every picture forming regions of frames in the length direction of the roll paper.

The preceding and other objects, features and advantages of the present invention will be apparent in the following detailed description of preferred embodiments to be taken in conjunction with the accompanying drawings, in which like reference numerals are used to identify the same or similar parts in the several views.

DETAILED DESCRIPTION OF THE PREFERRED EMBODIMENTS

Figure 1:
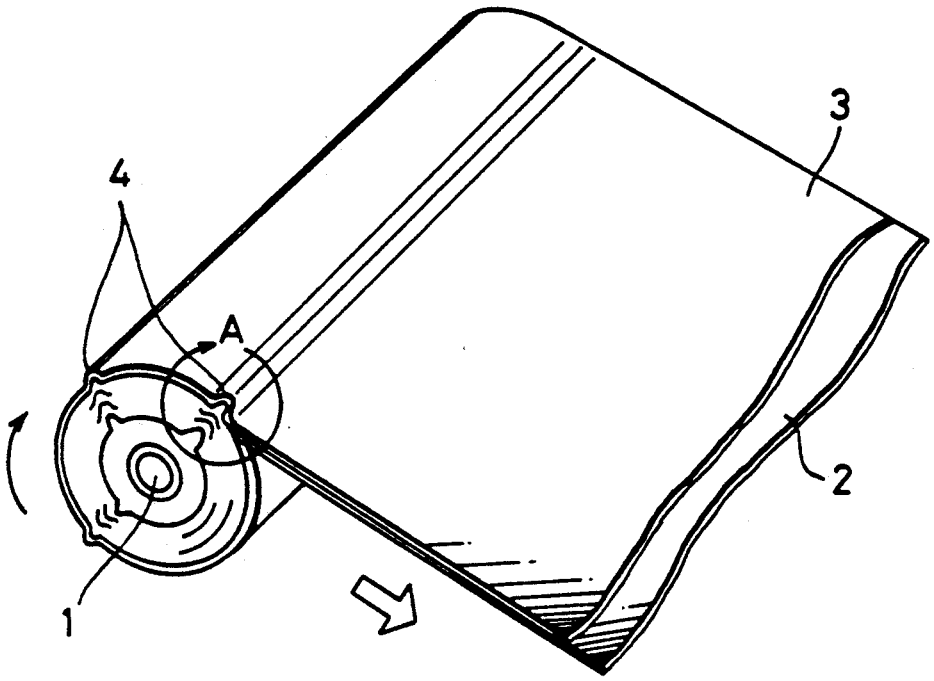
FIG. 1 (PRIOR ART)
FIG. 1 is a perspective view of a conventional roll paper for a thermal printer.
Figure 2:
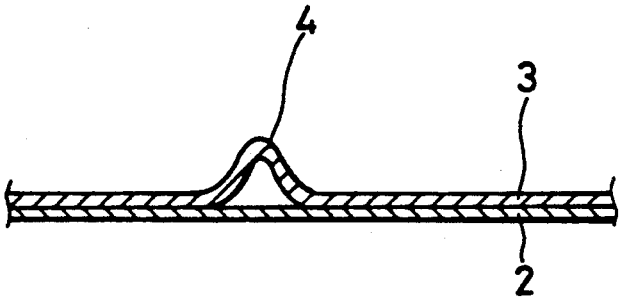
FIG. 2 (PRIOR ART)
FIG. 2 is a cross-sectional view illustrating the portion A in FIG. 1 in an enlarged scale.
Figure 3:
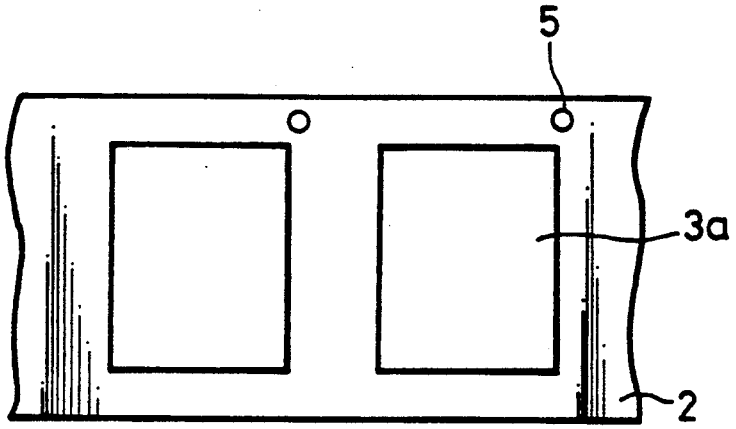
FIG. 3 (PRIOR ART)
FIG. 3 is a plan view of another example of the conventional roll paper for a thermal printer.
Figure 4:
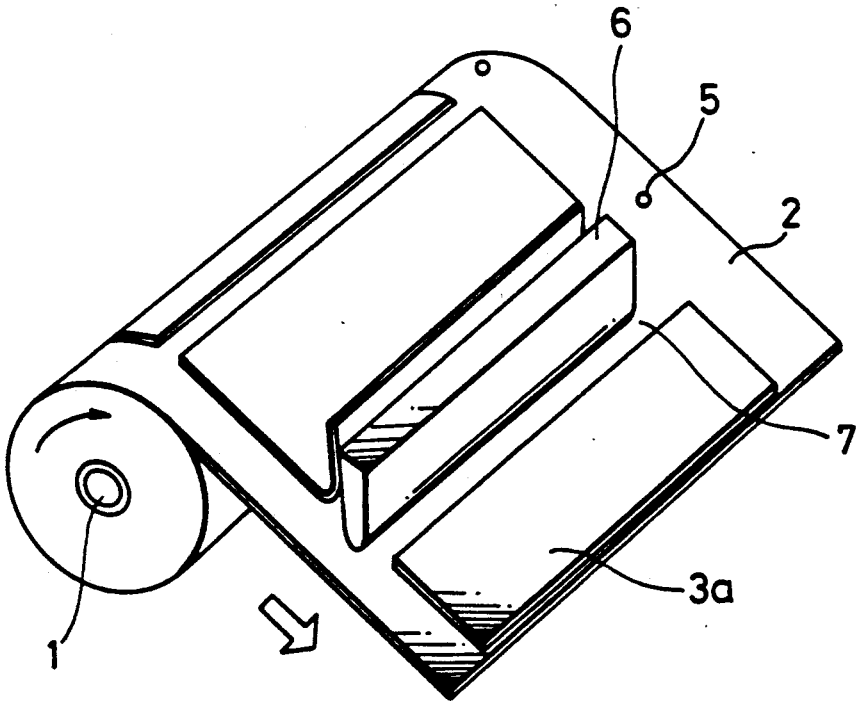
FIG. 4 (PRIOR ART)
FIG. 4 is a perspective view used to explain the conventional roll paper for a thermal printer shown in FIG. 3.
Figure 5:
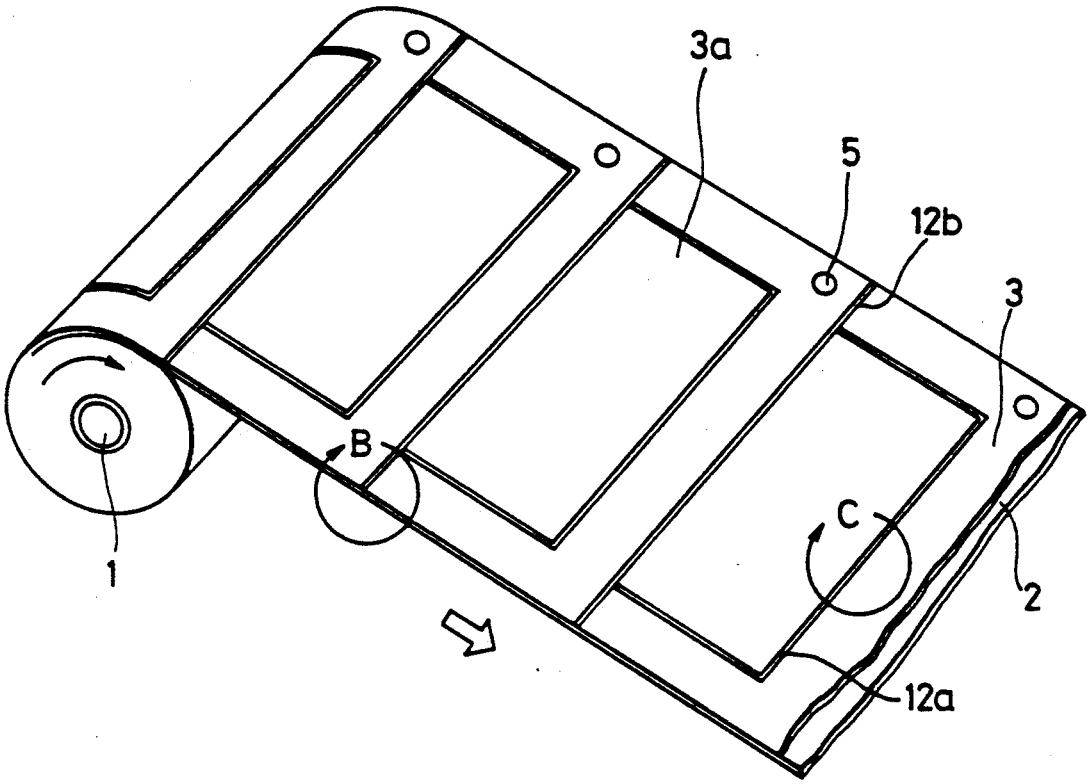
FIG. 5 is a perspective view of an embodiment of the roll paper for a thermal printer according to the present invention.
Figure 6:
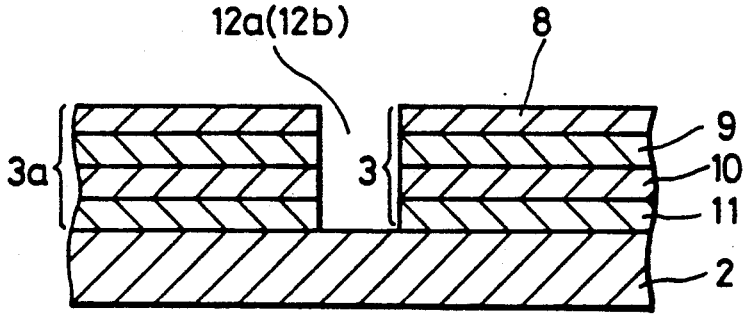
FIG. 6 is a cross-sectional side view illustrating the portions B and C in FIG. 5 in an enlarged scale.

A first embodiment of a roll paper for a thermal printer according to the present invention will hereinafter be described with reference to FIGS. 5 and 6. In FIGS. 5 and 6, like parts corresponding to those of FIGS. 1 to 4 are marked with the same references.

In FIGS. 5 and 6, it will be seen that the peeling paper 2 is shaped substantially as a tape about 110 mm wide and 0.05 mm thick. Similarly, the coloring paper 3 is shaped substantially as a tape about 110 mm wide and 0.01 mm thick, and this coloring paper 3 is stuck on the peeling paper 2 as a unitary body. More specifically, as shown in FIG. 6, the coloring paper 3 is comprised of a synthetic paper 10 having an adhesive layer 11 formed thereunder, a heat-sensitive dye containing layer 9 containing dyes or other coloring agents for printing an image on the synthetic layer 10 and an over-coat layer 8 formed on the thermal coloring layer 9 to protect the heat-sensitive dye containing layer 9.

In this embodiment, on the rolled paper for a thermal printer having the coloring paper 3 stuck on the peeling paper 2, there are formed a plurality of closed first cuts 12*a* to define rectangular label-like portions 90 mm wide in the tape width direction and 55 mm long in the tape length direction, that is, areas of picture portions 3*a*. The closed first cuts 12*a* are sequentially formed at a pitch of about 85 mm on the thermal rolled paper in its longitudinal direction. The closed first cuts 12*a* may be deep enough to reach the lower surface of the adhesive layer 11 formed on the peeling layer 2.

Further, second cuts 12*b* are formed on the tape of the rolled thermal paper so as to fully cross its entire width of 110 mm in the vicinity of the plurality of the picture forming portions 3*a* surrounded by the closed first cuts 12*a*. In the case of FIG. 5, the second cut 12*b* is formed common to the left-hand cut of the first cut 12*a*. The starting end detection apertures 5 are provided along the left or right edge of the tape for detecting the starting ends of the picture forming portions 3*a*. Every starting ends of the picture forming portions 3*a* are detected by a light emitting element and a light receiving element which are provided in the printer side, though not shown. Then, pictures are formed on the picture forming portions 3*a* by the thermal print head.

The aforementioned first and second cuts 12*a* and 12*b* are formed by rotating along the thermal rolled paper a cutter having a cutter blade whose shape is substantially the same as that formed by the first and second cuts 12*a* and 12*b*. Such thermal paper is rolled around the spool 1 having a diameter of 36.5 mm until the diameter of the roll of paper reaches about 50 mm.

According to the above embodiment of the present invention, there is no difference in level between the peeling paper 2 and the coloring paper 3 even if they are stuck one upon another and rolled, the label-like coloring paper 3*a* can be prevented from being peeled off by the thermal print head, and therefore, the occurrence of jamming upon printing can be reduced considerably. Moreover, even when the tape-like peeling paper 2 and coloring paper 3 are rolled around the spool 1, there is no level difference. Therefore, it can be avoided that the upper and lower rolled coloring papers are pressed by the steps and are sensed to the winding pressure to form stripes on the coloring paper. Furthermore, the second cuts 12*b* can absorb the occurrence of the wrinkles 4, thus removing the causes of the defective prints upon printing.

Figure 7A:
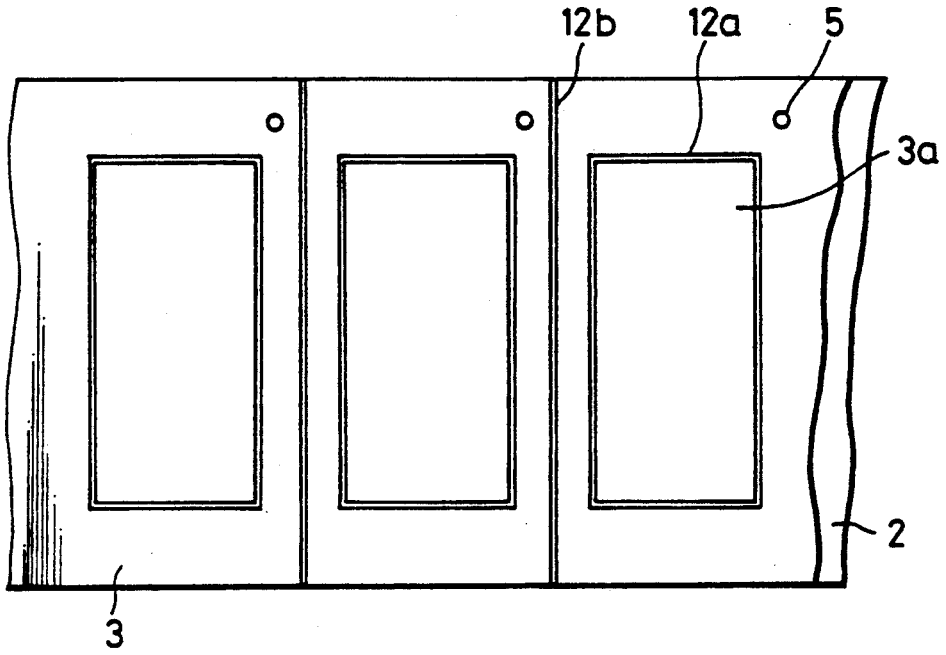
FIGS. 7A and 7B are plan views of other embodiments of the roll paper for a thermal printer according to the present invention, respectively.
Figure 7B:
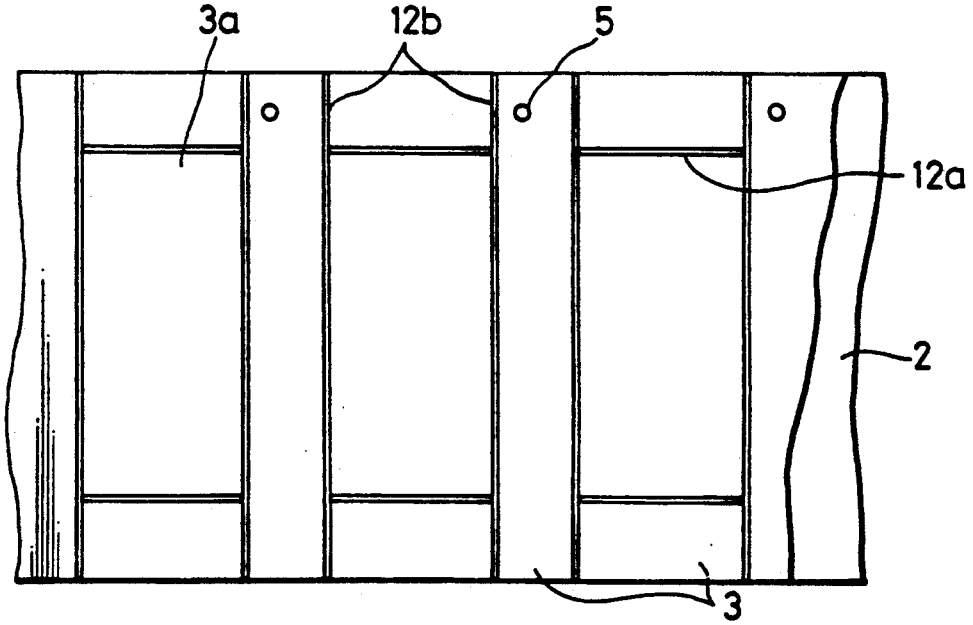

FIGS. 7A and 7B are plan views of other embodiments of the roll paper for a thermal printer according to the present invention, respectively. While the left-side edge of the first cut 12*a* is formed common to the second cut 12*b* as described with reference to FIG. 5, in the case of FIG. 7A, the second cuts 12*b*, 12*b* . . . are provided between the first cuts 12*a*, 12*a*, . . . Moreover, in the case of FIG. 7B, the second cuts 12*b* for preventing wrinkles from being produced due to the rolled state are provided common to both the right-and-left side cuts of each first cut 12*a*. These structures of FIGS. 7A and 7B can achieve the similar effects to those of FIG. 5.

According to the roll paper for a thermal printer according to the present invention, wrinkles can be prevented from occurring due to the rolled state, thereby removing defective prints. Furthermore, since there is no difference in level, the label-like portions can be avoided from being peeled off, thus decreasing the troubles of jamming.

Having described preferred embodiments of the invention with reference to the accompanying drawings, it is to be understood that the invention is not limited to those precise embodiments and that various changes and modifications thereof could be effected by one skilled in the art without departing from the spirit or scope of the novel concepts of the invention as defined in the appended claims.

We claim as our invention:

1. A roll paper for a thermal print in which a coloring paper having a synthetic paper, a heat-sensitive dye containing layer, and a peeling paper are wound as a roll shape, said peeling paper being affixed to the synthetic sheet by an adhesive material, comprising:

first cuts for defining a picture forming region of one frame on said coloring paper In order for said picture forming region to be peeled off from said peeling paper, said picture being formed on said synthetic paper when in the heat-sensitive dye is heated by the thermal head of said thermal printer; and second cuts made completely across the entire width of said roll paper, in which said first and second cuts are repeatedly made at every said picture forming region in the length direction of said roll paper.

2. A roll paper for a thermal printer according to claim 1, wherein said coloring paper comprises:

a synthetic paper having an adhesive layer coated thereunder;

a heat-sensitive dye containing layer is formed on said synthetic sheet; and an overcoating layer is formed on the heat sensitive dye containing layer to protect said heat sensitive dye containing layer.

3. A roll paper for a thermal printer according to claim 2, wherein said first cuts are deep enough to reach a lower surface of said adhesive layer.

4. A roll paper for a thermal printer according to claim 1, wherein said second cuts are provided between said first cuts.

5. A roll paper for a thermal printer according to claim 1, wherein said second cuts are provided common to both a right-and-left side cut of each of said first cuts.

* * * * *